US009505021B2

(12) United States Patent
Dellea et al.

(10) Patent No.: US 9,505,021 B2
(45) **Date of Patent: *Nov. 29, 2016**

(54) FACILITY AND METHOD FOR DEPOSITING A FILM OF ORDERED PARTICLES ONTO A MOVING SUBSTRATE

(75) Inventors: Olivier Dellea, La Talaudiere (FR); Pascal Fugier, Bernin (FR); Philippe Coronel, Barraux (FR)

(73) Assignee: Commissariat a l'energie atomique et aux energies alternatives, Paris (FR)

( * ) Notice: Subject to any disclaimer, the term of this patent is extended or adjusted under 35 U.S.C. 154(b) by 449 days.

This patent is subject to a terminal disclaimer.

(21) Appl. No.: 14/001,088

(22) PCT Filed: Feb. 20, 2012

(86) PCT No.: PCT/EP2012/052842

§ 371 (c)(1),
(2), (4) Date: Aug. 22, 2013

(87) PCT Pub. No.: WO2012/113745

PCT Pub. Date: Aug. 30, 2012

(65) Prior Publication Data

US 2013/0330471 A1 Dec. 12, 2013

(30) Foreign Application Priority Data

Feb. 24, 2011 (FR) ..... 11 51516

(51) Int. Cl.

| | |
|---|---|
| ***B05C 19/02*** | (2006.01) |
| ***B05D 1/20*** | (2006.01) |
| ***B05D 1/00*** | (2006.01) |
| ***B05C 19/00*** | (2006.01) |

(52) U.S. Cl.

CPC ..... *B05C 19/02* (2013.01); *B05C 19/00* (2013.01); *B05D 1/00* (2013.01); *B05D 1/20* (2013.01); *B05D 1/204* (2013.01); *B05D 2252/02* (2013.01)

(58) Field of Classification Search

CPC ..... B05C 19/00; B05C 19/02
USPC ..... 427/180, 294; 118/600
See application file for complete search history.

(56) References Cited

U.S. PATENT DOCUMENTS

| | | | | |
|---|---|---|---|---|
| 7,804,134 | B2 | 9/2010 | Coronel et al. | |
| 2005/0281944 | A1* | 12/2005 | Jang | B05D 1/02 427/180 |
| 2013/0052552 | A1 | 2/2013 | Phan et al. | |

FOREIGN PATENT DOCUMENTS

| | | |
|---|---|---|
| EP | 0 640 406 | 3/1995 |
| EP | 1 647 334 | 4/2006 |
| WO | 02 13979 | 2/2002 |

OTHER PUBLICATIONS

U.S. Appl. No. 14/369,752, filed Jun. 30, 2014, Dellea, et al.
U.S. Appl. No. 14/375,858, filed Jul. 31, 2014, Dellea, et al.

(Continued)

*Primary Examiner* — Alexander Weddle
(74) *Attorney, Agent, or Firm* — Oblon, McClelland, Maier & Neustadt, L.L.P.

(57) ABSTRACT

A facility for depositing a film of ordered particles onto a moving substrate, the facility including: a transfer area including an entry of particles and an exit of particles spaced apart from each other by two side edges facing each other, retaining a carrier liquid on which the particles float, a capillary bridge ensuring connection between the carrier liquid contained in the transfer area and the substrate, and a plurality of suction nozzles capable of attracting the particles towards its two side edges.

15 Claims, 9 Drawing Sheets

(56) References Cited

OTHER PUBLICATIONS

U.S. Appl. No. 14/375,994, filed Jul. 31, 2014, Dellea, et al.
U.S. Appl. No. 14/375,532, filed Jul. 30, 2014, Dellea, et al.
U.S. Appl. No. 14/131,082, filed Jan. 6, 2014, Dellea, et al.
International Search Report Issued May 30, 2012 in PCT/EP12/052842 filed Feb. 20, 2012.
U.S. Appl. No. 14/398,340, filed Oct. 31, 2014, Savelli, et al.
U.S. Appl. No. 14/423,957, filed Feb. 25, 2015, Dellea, et al.

* cited by examiner

FIG. 6a"

FACILITY AND METHOD FOR DEPOSITING A FILM OF ORDERED PARTICLES ONTO A MOVING SUBSTRATE

TECHNICAL FIELD

The invention relates to the field of facilities and methods for depositing a film of ordered particles, onto a moving substrate.

More specifically, it relates to the deposition of a film of ordered particles, preferably of the monolayer type, the particle size of which may be comprised between a few nanometers and several hundred micrometers. The particles, preferably of spherical shape, may for example be silica particles.

The invention has many applications, in particular in the field of fuel cells, optics, photonics, polymeric coatings, chips, MEMs, surface structuration for organic electronics and photovoltaics, etc.

STATE OF THE PRIOR ART

Such methods and facilities aiming at depositing a film of ordered particles onto a moving substrate are known from the prior art, the latter substrate may be flexible or rigid.

Generally, a transfer area is provided, supplied with particles which float in a carrier liquid contained in this same transfer area. The ordered particles in the transfer area, forming a monolayer of particles, a so-called film of small thickness, are pushed by the arrival of other particles towards an outlet of this area, through which they reach the moving substrate onto which they are deposited. To do this, a capillary bridge usually ensures the connection between the substrate and the carrier liquid contained in the transfer area.

Under normal operating conditions of the facility, in the transfer area, the particles are maintained ordered by the pressure exerted upstream by the particles in motion intended to subsequently reach this transfer area. As an indicative example, when the area for transferring particles is connected upstream to a tilted ramp over which the particles stemming from a dispensing device pass, these are the same particles present on the tilted ramp which exert pressure on the particles contained in the transfer area, and which therefore give the possibility of keeping the ordering of the particles in this area, until they are deposited on the substrate by capillarity.

Always in this same exemplary configuration integrating a tilted ramp, it is the kinetic energy associated with these moving particles on the ramp which allow the latter to be automatically ordered on this same ramp, when they impact the front of particles, itself also located on the tilted ramp. The ordering is therefore established on the ramp, and then preserved when the ordered particles penetrate into the transfer area, by the continuous supply of particles which will impact the front.

The kinetic energy required for ordering the particles is brought here by the tilted ramp conveying the carrier liquid and the particles. Other solutions are nevertheless possible, such as setting into motion, by means of a pump, the carrier liquid on a horizontal plane, the downstream portion of which forms the transfer area of the particles. Another solution consists of replacing said pump with a fan allowing an air flow to be applied to the surface of the carrier liquid, on which the particles float.

In all these embodiments of the prior art, and in particular in the one applying the tilted ramp, a problem is encountered which occurs at the moment of putting the facility into operation. Indeed, during this initiation phase, during which the substrate is not yet set into motion, the transfer area is gradually filled with particles. However, these particles do not have the possibility of being ordered before their entry into the transfer area, since the front of particles does not yet sufficiently move up upstream. Instead of this, the particles first disperse in a disordered way into the transfer area and then subsequently form clusters because of the capillarity forces between the particles.

If these clusters of particles end up by joining up together during the initial filling of the transfer area, when the filling level of the latter becomes a high level, voids are formed between these clusters, which makes the film non-homogeneous and therefore unsatisfactory. In other words, if the ordering of the particles within each cluster may be appropriate, the gathered clusters form a set of particles in which there are voids, which does not give the possibility of obtaining a film having in every point, a so-called <<compact hexagonal>> structure in which each particle is surrounded and in contact with six other particles in contact with each other.

Still during the initiation phase, when the front of particles moves up beyond the transfer area, upstream, the particles impacting the front then give the possibility of exerting pressure on the clusters gathered in the transfer area. Moreover, it is noted that these particles manage to be automatically ordered on the tilted ramp, in the way described above. Nevertheless, the pressure forces exerted by these particles very often prove to be insufficient for filling the voids between the gathered clusters, because of the strong internal stresses within these clusters which prevent reordering of the particles.

In order to increase the pressure applied to the gathered clusters in the transfer area, it is possible to have the front of particles move up still further on the ramp. Nevertheless, this has generally the consequence of generating overlappings of beads which end up by being superposed instead of being ordered according to a single layer. In such a case, the quality of the film is of course estimated to be also unsatisfactory.

Therefore, the film of particles located in the transfer area before setting the facility into operation, has quality defects which require it to be cleared by deposition on a dedicated substrate. This is first of all expressed by unnecessary consumption of particles and of substrates, having an impact on the production costs.

These same costs are also increased due to the complexification of the method, which therefore requires a purging phase aiming at depositing the portion of the non-compliant film, and then of clearing it. Further, the risks of dissemination of the particles are amplified, notably when the latter are of small dimensions for example of less than 400 nm.

SUMMARY OF THE INVENTION

The object of the invention is therefore to find at least partly a remedy to the drawbacks mentioned above, relative to the embodiments of the prior art.

To do this, the object of the invention is first of all a facility for depositing a film of ordered particles onto a moving substrate, the facility comprising:

a transfer area comprising an entry of particles and an exit of particles, spaced apart from each other by two side edges facing each other, retaining a carrier liquid on which the particles float, said facility being designed for allowing deposition, on the substrate, of the film of ordered particles escaping through said exit of particles, preferably by means of a capillary bridge which therefore ensures the connection between the carrier liquid contained in the transfer area and said substrate onto which the film of ordered particles is intended to be deposited.

According to the invention, the facility further includes a plurality of suction nozzles capable of attracting the particles present in the transfer area towards its two side edges.

The invention therefore provides suction nozzles giving the possibility of stretching the film of particles over the whole length of the transfer area, in order to avoid the formation of an assembly of particles in which there are voids, as this was the case in the prior art. Thus, these nozzles allow satisfactory ordering of the particles in the transfer area, during the initiation phase consisting in its initial filling. Subsequently, under normal conditions, these nozzles may be disabled, the ordering of the particles then being carried out automatically.

By obtaining satisfactory ordering, as soon as the initiation phase, no portion of the particles or of the substrate has to be cleared, implying that it is not necessary to isolate the portion of the finished product stemming from the initiation phase. The production costs are thereby substantially reduced. They are also reduced by the simplification of the method, which no longer requires any purging phase aiming at depositing a portion of the non-compliant film, and at clearing it. Further, the risks of dissemination of the particles is also reduced.

Thus, the invention is remarkable in that, in a simple and efficient way, it gives the possibility of avoiding the formation of clusters, first isolated and then grouped in an unsatisfactory way, as this was the case in the prior art. The suction nozzles are actually a simple system for stretching the film laterally, towards each of the two edges, and ensuring that the film produced has, in every point, a so-called <<compact hexagonal>> structure, in which each particle is surrounded and in contact with six other particles in contact with each other.

Preferably, the facility only includes two suction nozzles, respectively capable of attracting the particles present in the transfer area towards either one of the two side edges. Nevertheless, each edge may be associated with several nozzles, without departing from the scope of the invention.

Preferably, the facility comprises a tilted ramp for circulation of the particles, attached to said entry of the transfer area, and over which said carrier liquid is also intended to circulate. The kinetic energy required for ordering the particles under normal conditions is brought here by the tilted ramp transporting the carrier liquid and the particles. Other solutions are nevertheless possible, such as setting into motion, by means of a pump, the carrier liquid on a horizontal plane, the downstream portion of which forms the area for transfer of the particles. Another solution consists of replacing the pump with a fan allowing an airflow to be applied to the surface of the carrier liquid, on which the particles float.

Preferably, the facility comprises means for temporarily retaining the particles in the transfer area at a distance from said substrate, these retention means being capable of being moved towards this substrate while retaining said particles thereof. This displacement may be considered manually, or else in an automated way.

Globally, these retention means give the possibility of reducing the size of the transfer area during its initial filling, during the initiation phase. Several advantages result from this.

First of all, this reduces the surface area on which the nozzles assist the particles for ensuring their ordering. The control of these nozzles is thus more simple to be achieved. Further, this gives the possibility of facilitating the ordering, in the sense that the pressure exerted on the particles of the transfer area, by the particles located upstream from this area, is more effective for forcing the particles to be ordered when the latter extend over a shorter length. It has been seen that the beneficial effects mentioned above are even more significant when an upstream end of these temporary retention means is located at a distance of less than 20 mm from the entry of the transfer area.

Subsequently, these temporary retention means are provided so as to be moved towards the exit of the transfer area and the substrate, in order to allow deposition of the film of particles onto the latter. Moreover, according to a preferred embodiment of the invention, the retention means are also provided so as to be deposited on the substrate upstream from the film of particles. Nevertheless, solutions without deposition on the substrate may be contemplated, without departing from the scope of the invention.

Preferably, said temporary retention means for the particles assume the form of a layer in a hydrophobic material, floating at the surface of the carrier liquid. This solution proves to be simple and effective in order to form a barrier to the particles which can neither pass above the layer because of the hydrophobicity which prevents wetting of the upper surface of the layer, nor pass between the layer and the carrier liquid by means of the small thickness of the barrier which allows easy deformation in order to adapt to the shape variations of the surface of the carrier liquid. Moreover, this layer has a thickness preferentially comprised between few microns and a few tens of microns for example between 50 and 100 μm.

This is preferably a layer of polytetrafluoroethylene (PTFE).

Preferably, said temporary retention means assume the form of a layer, one downstream end of which is also located at a distance from the substrate.

Alternatively, said temporary retention means assume the form of a layer, a downstream end of which is located on said substrate. In the latter case, it is not necessary to provide specific means for ensuring that the retention means are held and set into motion, since it is the substrate which blocks them in the transfer area and which causes their movement at the intended instant, by carrying them away. In both cases the layer on the carrier liquid may then have a behavior substantially identical with that of the film of ordered particles formed in the transfer area. This allows deposition of this layer for retaining particles onto the substrate, also preferably via the capillary bridge, as this was mentioned above.

The object of the invention is also a method for depositing a film of ordered particles onto a moving substrate, by means of a facility as described above, according to which, during at least one portion of the initial step for filling the transfer area with the particles, said suction nozzles are actuated in order to attract the particles present in the transfer area towards its two side edges.

Preferably, said nozzles are alternately actuated so as to attract the particles present in the transfer area towards either one of the two side edges, alternately. Simultaneous actuation may nevertheless be contemplated, without departing from the scope of the invention. However, alternate actuation which may integrate pause periods between the changes of nozzles, is preferred for its greater simplicity for adjustment. Further, the pause periods allow the particles to continue to accumulate, thus allowing pressurization of the particles already present.

Preferably, after setting into place the temporary retention means for the particles in the transfer area at a distance from said substrate, and after initial filling with particles of the portion of the transfer area located upstream from said temporary retention means, the latter are moved in said transfer area towards the substrate, while retaining said particles. Of course, during this displacement of the retention means which aims at bringing the downstream front of particles closer to the substrate, the transfer area which extends gradually, continues to be continuously supplied with other particles, so that the downstream front is preferentially maintained at the same location of the facility.

Finally as mentioned above, it is preferentially ensured that said temporary retention means assume the form of a layer which is gradually deposited on the moving substrate, while the downstream front of the film of ordered particles which it retains is moved towards the exit of said transfer area. Thus, on the obtained finished product, the retention layer is deposited onto the substrate in the continuity of the deposit of the film of particles, in the same way as this retention layer was located in the continuity of the film of particles in the transfer area, before their deposition.

Other advantages and features of the invention will become apparent in the non-limiting detailed description below.

SHORT DESCRIPTION OF THE DRAWINGS

This description will be made with reference to the appended drawings wherein.

DETAILED DESCRIPTION OF PREFERRED EMBODIMENTS

Figure 1:
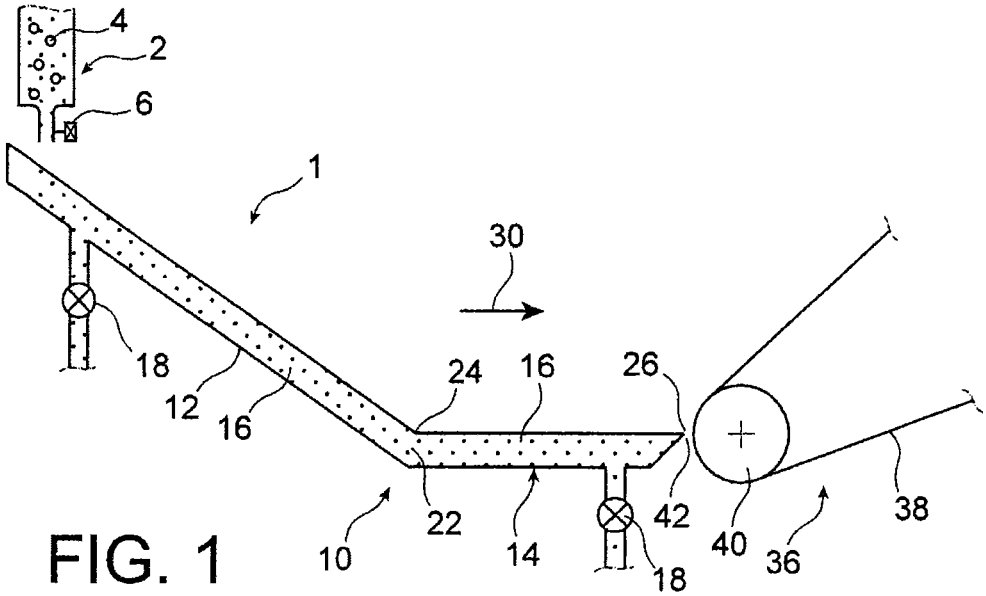
FIG. 1 shows a deposition facility according to a preferred embodiment of the present invention, in a schematic sectional view taken along the line I-I of FIG. 2.
Figure 2:
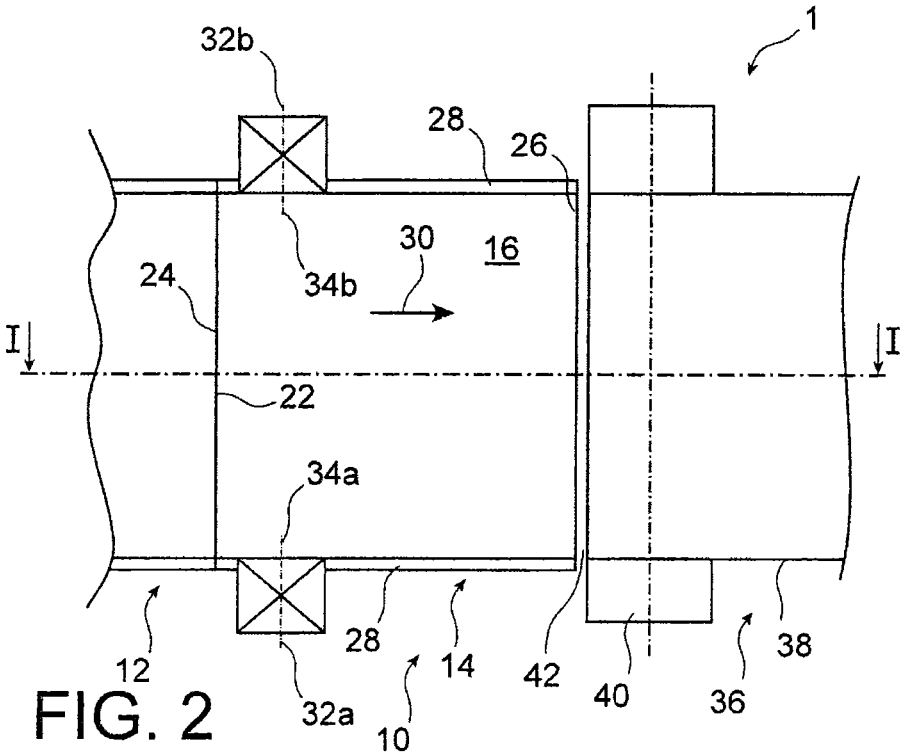
FIG. 2 illustrates a schematic top view of the deposition facility shown in FIG. 1.

Referring first of all to FIGS. 1 and 2, a facility 1 for depositing a film of ordered particles onto a moving substrate may be seen.

The facility includes a device 2 for dispensing particles 4, the size of which may be comprised between a few nanometers and several hundred micrometers. The particles, preferably of spherical shape, may for example be silica particles.

More specifically, in the preferred embodiment, the particles are silica spheres with a diameter of about 1 μm, stored in a solution in the dispensing device 2. The proportion of the medium is of about 7 g of particles for 200 ml of solution, here butanol. Naturally, for reasons of clarity, the particles illustrated in the figures adopt a diameter greater than their actual diameter.

The dispensing device 2 has a controllable injection nozzle 6, with a diameter of about 500 μm.

The facility also includes a conveyor 10 of liquid, integrating a tilted ramp 12 for circulation of the particles, and a substantially horizontal transfer area 14. The upper end of the tilted ramp is provided for receiving the particles injected from the dispensing device 2. This ramp is straight, tilted by an angle comprised between 5 and 60°, preferably between 20 and 60°, allowing the particles to be conveyed towards the transfer area 14. Further, a carrier liquid 16 circulates on this ramp 12, as far as into the transfer area. This liquid 16 may moreover be recirculated by means of one or two pumps 18, between the transfer area 14 and the upper end of the ramp. Preferably here, this is deionized water on which the particles 4 may float.

The low end of this same ramp is connected to an entry of the area 14 for transferring particles. This entry 22 is located at an inflexion line 24 materializing the junction between the surface of the carrier liquid present on the tilted plane of the ramp 12, and the surface of the carrier liquid present on the horizontal portion of the transfer area 14.

The entry of particles 22 is spaced apart from an exit of particles 26 by means of two side edges 28 retaining the carrier liquid 16 in the area 14. These edges 28, facing each other and at a distance from each other, extend parallel to a main flow direction of the carrier liquid and of the particles in the facility, this direction being schematized by the arrow 30 in FIGS. 1 and 2. The area 14 therefore assumes the form of a corridor or a path open at its entry and at its exit.

The transfer area 14 is equipped with two suction nozzles 32*a*, 32*b*, capable of sucking up particles towards the two edges 28, as this will be described hereafter. More specifically, with each edge 28 is associated a suction nozzle, the axes 34*a*, 34*b* of which are oriented orthogonally to the direction 30.

The nozzles 32*a*, 32*b* may be directly attached on the edges 28, or else on another portion of the facility 1. The suction axes 34*a*, 34*b* are parallel to the inflexion line 24 and at a small distance from the latter in a top view such as the one shown in FIG. 2, this distance being for example comprised between 0 mm (on the inflexion line 24) and 10 mm. The suction axes are preferentially positioned at the air/liquid carrier interface. Each nozzle has an inner diameter of the order of 3 to 5 mm.

The facility 1 is also provided with a substrate conveyor 36, intended to set the substrate 38 in motion. This substrate may be rigid or flexible. In the latter case, it may be set into motion on a roller 40, the axis of which is parallel to the exit 26 of the area 14, in proximity to which it is located. Indeed, the substrate 38 is intended to move very close to the exit 26, so that the particles escaping from this exit may be easily deposited onto this substrate, via a capillary bridge 42 connecting it to the carrier liquid 16. Alternatively, the substrate may be in direct contact with the transfer area, without departing from the scope of the invention. The capillary bridge mentioned above is then no longer required.

In the example shown in the figures, the width of the substrate corresponds to the width of the area 14 and of its exit 26. The capillary bridge 42 is provided between the carrier liquid 16 which is located at the exit 26, and a portion of the substrate 38 closely fitting the guiding/driving roller 40. The axis of rotation of this latter roller may be located in the plane of the upper surface of the carrier liquid retained in the area 14.

Alternatively, in particular when the substrate 38 is solid, it may be moving along the vertical direction, orthogonal to the direction 30.

A method for depositing a film of ordered particles may now be described with reference to FIGS. 3 to 9.

Figure 3:
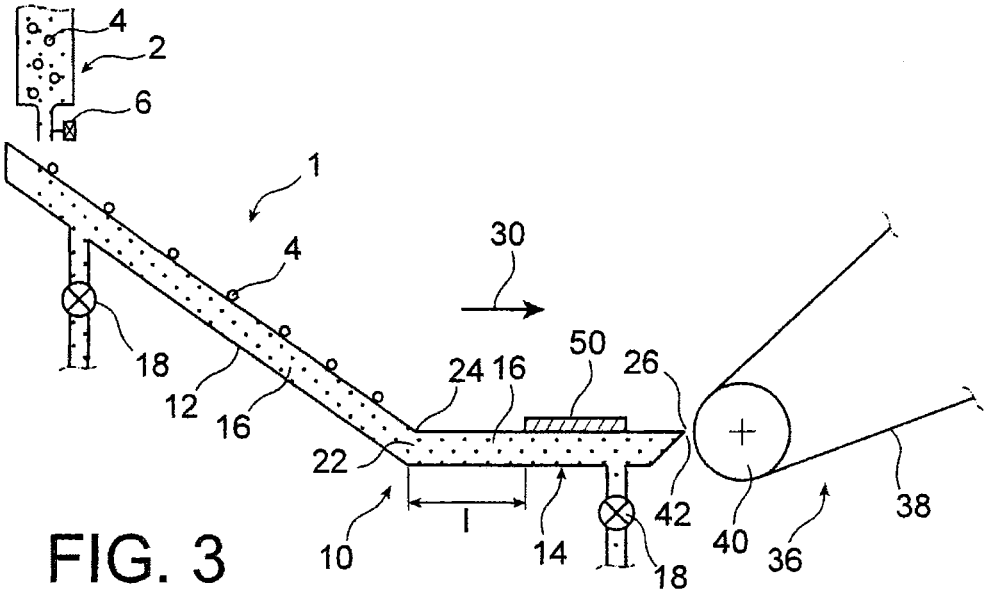
FIGS. 3 to 9 illustrate different steps of a deposition method applied by means of the facility shown in the previous figures.
Figure 4:
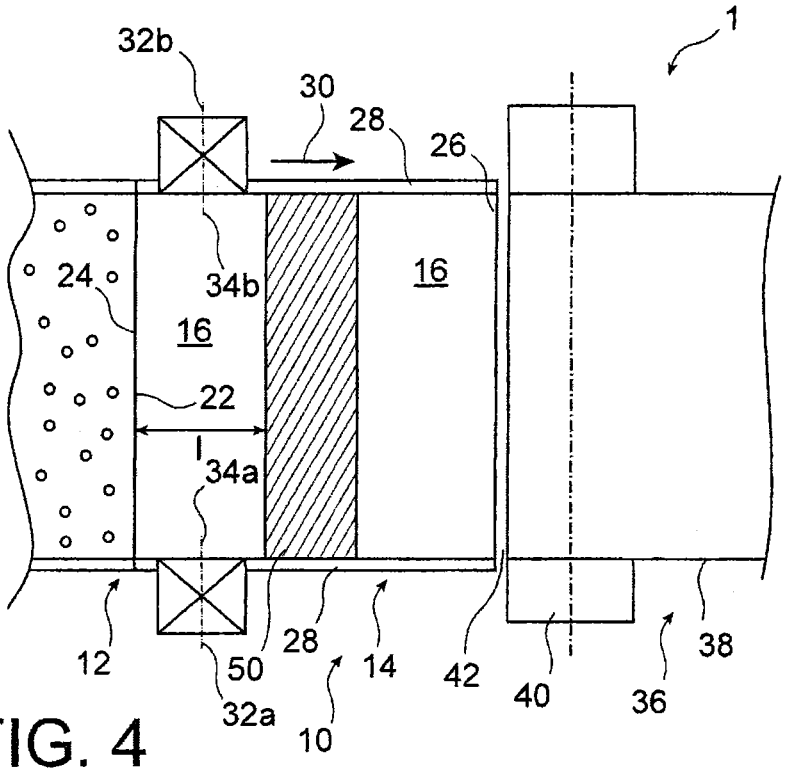

First of all, it is proceeded with effective and temporary reduction of the length of the transfer area 14. This reduction, although optional, gives the possibility of obtaining a finished product with even more satisfactory quality, in particular when the initial length of the area 14 is supposed to be great. In this respect, it is ensured that the new length <<I>> of the area 14, referenced in FIGS. 3 and 4, is less than 20 mm.

To do this, temporary retention means for the particles are set into place in the transfer area, these means therefore being intended to move the downstream front of particles away from the exit 26 and from the substrate 38, which is still not moving.

These means preferably assume the shape of a polytetrafluoroethylene (PTFE) layer 50 with a thickness comprised between 50 and 100 μm, floating at the surface of the carrier liquid 16. This technical solution proves to be simple and effective for subsequently producing a barrier to the particles which can neither pass over the layer because of the hydrophobicity which prevents wetting of the upper surface of the layer, nor pass between the layer 50 and the carrier liquid 16 by means of the small thickness of the barrier, which allows easy deformation for adapting to the variations in shape of the surface of the carrier liquid.

The layer 50 extends between both edges 28, so that no particle can pass to the interfaces. Its downstream end is therefore located at a distance from the substrate 38 and from the exit 26, upstream. Also, as mentioned above, its upstream end is located at a distance <<I>> from the entry 22 and from the inflexion line 24.

Once the Teflon layer 50 is in place, the injection nozzle 6 is activated so as to begin dispensing the particles 4 on the ramp 12. The idea is to apply an initial step for filling the transfer area 14, with the particles 4, upstream from the layer 50.

Figure 5:
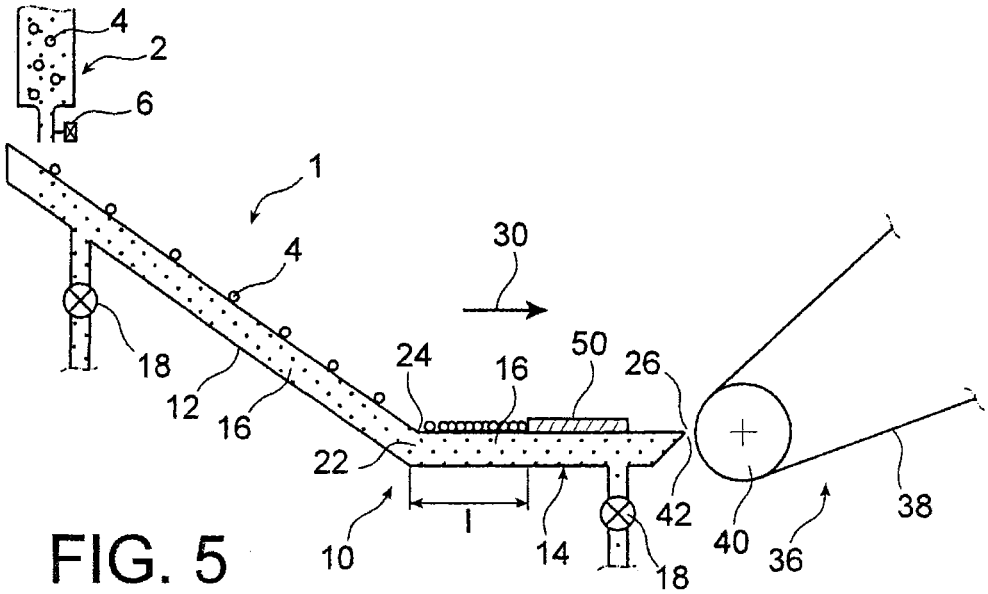
Figure 5A:
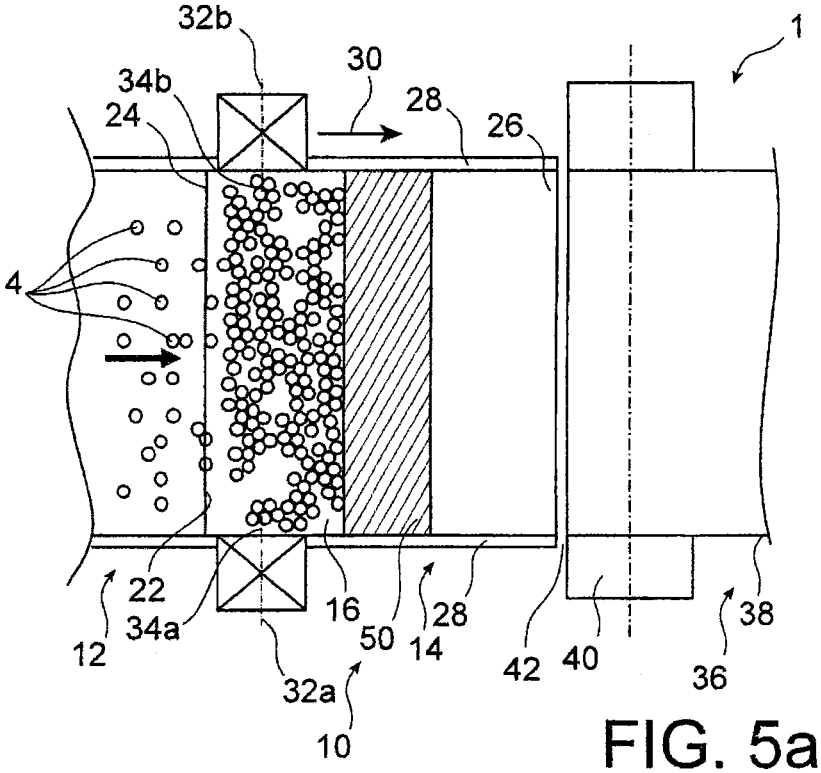

During this initiation phase, the particles dispensed by the device 5 circulate over the ramp 12 and then penetrate into the area 14 in which they are dispersed, until they are retained by the layer 50, as this was schematized in FIGS. 5 and 5*a*.

In order to limit the random dispersion and to obtain satisfactory ordering of the particles upstream and against the layer 50, the nozzles 32*a* and 32*b* are activated so as to stretch the film of particles orthogonally to the direction 30 in which they circulate.

Figure 6A:
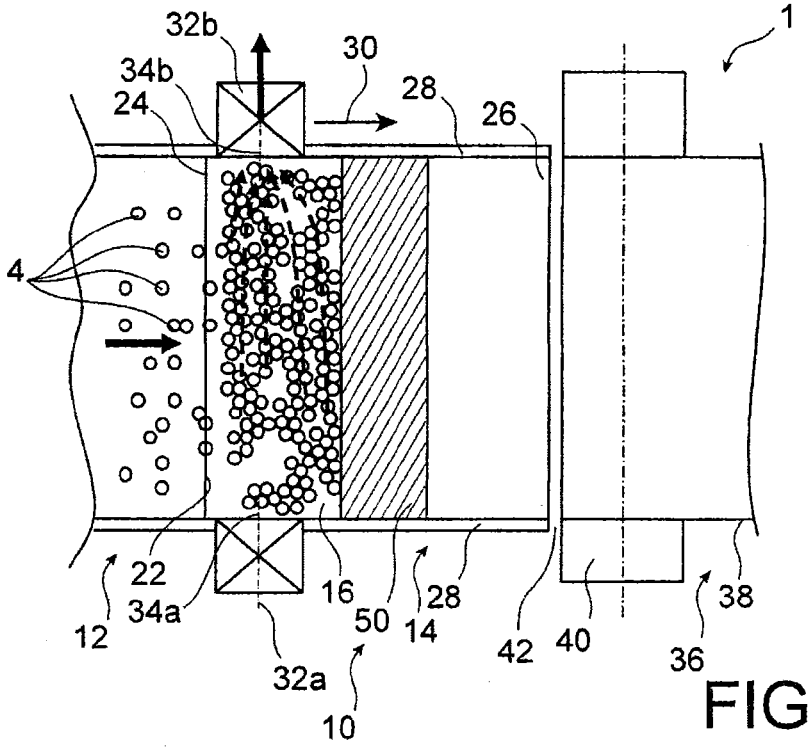
Figure 6A:
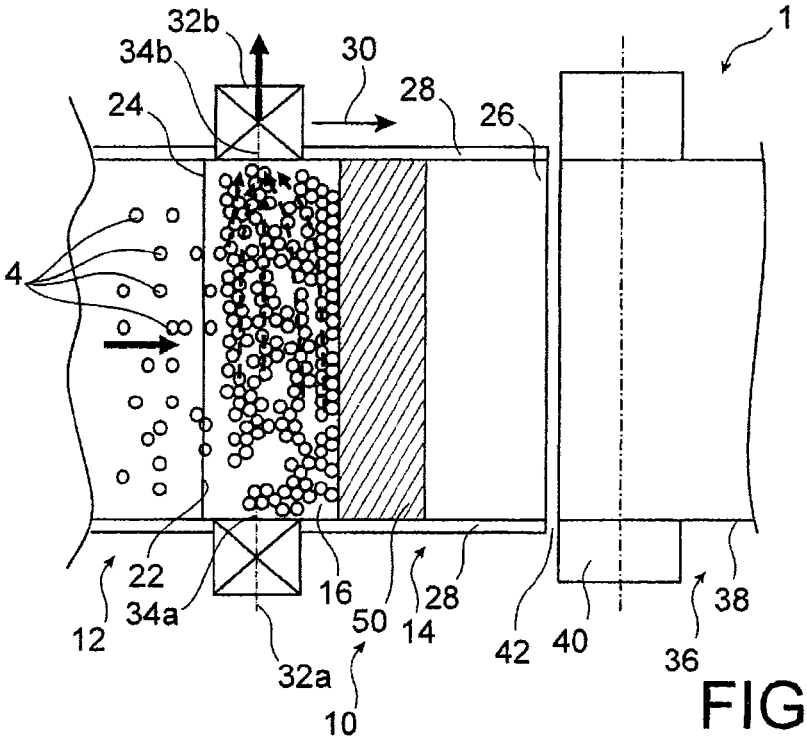

More specifically, in a first phase, it is the nozzle 32*b* which is activated, the other one remaining inactive. FIG. 6*a* shows that at the beginning of the suction, convection currents are established towards the associated edge 28. Next, FIG. 6*a'* shows that the film is pulled towards the suction nozzle 32*b*, and is stretched sideways, with the particles moving along the layer 50. Therefore, they become organized by causing reduction of the voids, and causing the ordering to begin in the vicinity of the layer 50, as shown in FIG. 6*a"*. A flow rate of the order of 65 mL/min may be applied.

Figure 6B:
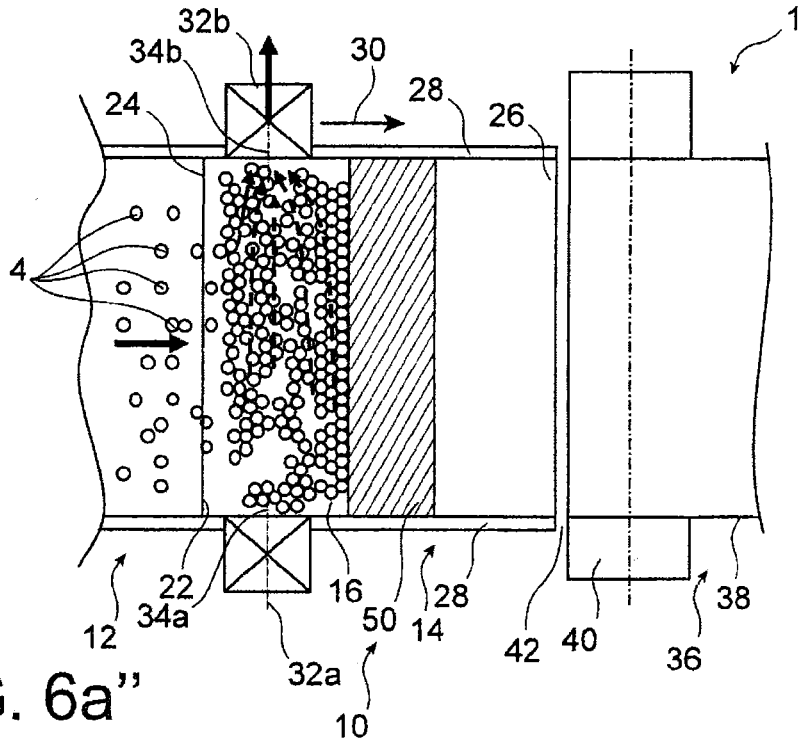
Figure 6B:
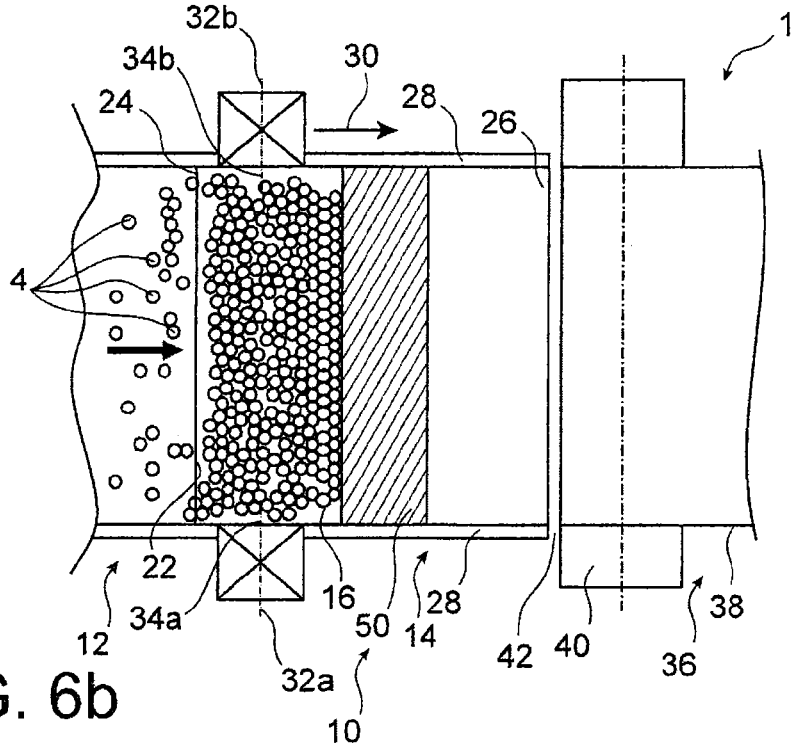

The nozzle 32*b* is then disabled, for a stoppage time during which the particles 4 may reorder, as shown in FIG. 6*b*, in particular by the pressure exerted by the particles arriving into the transfer area.

Next, it is the turn of nozzle 32*a* to be activated, the other one now remaining inactive.

Figure 6C:
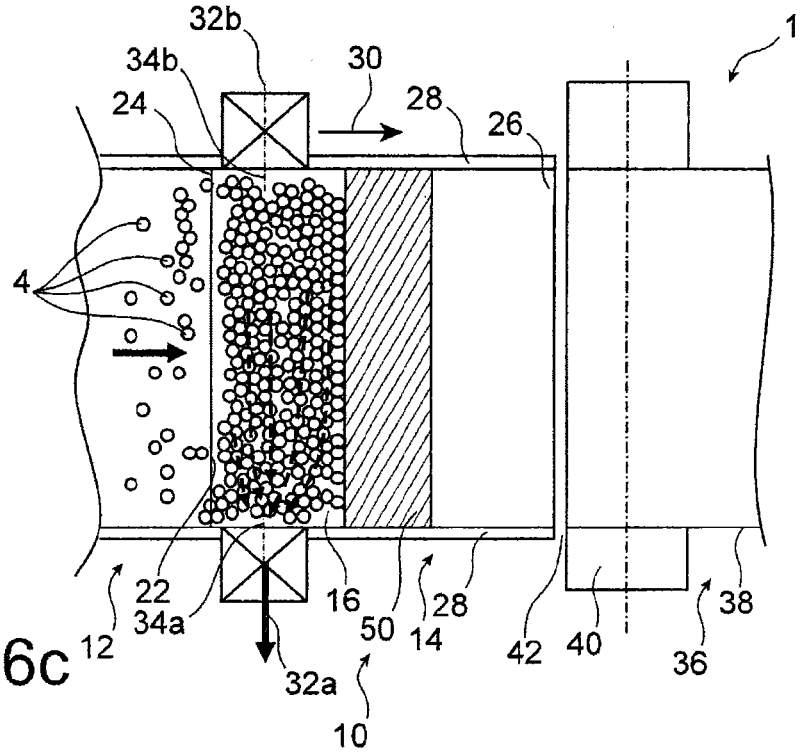
Figure 6C:
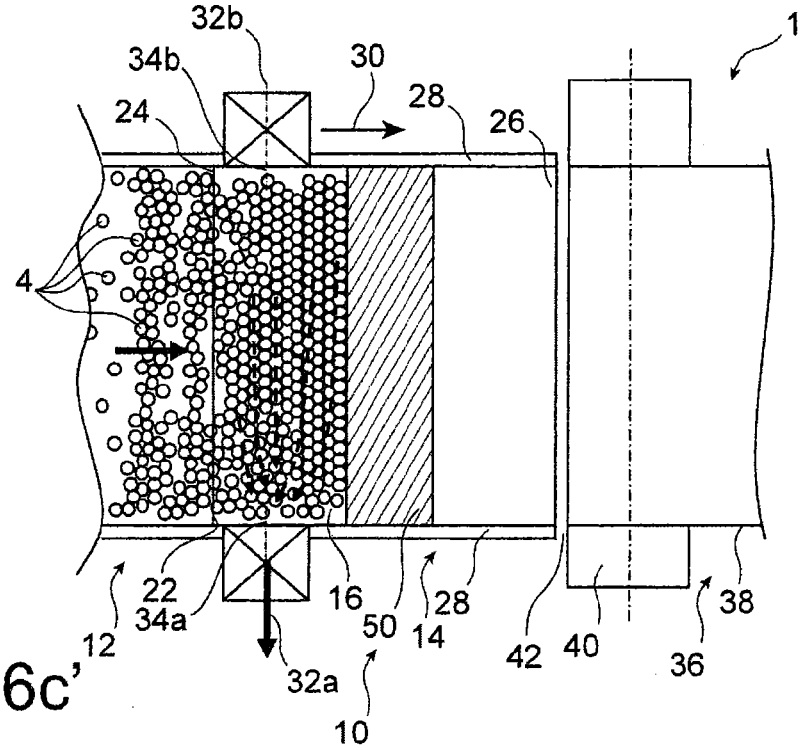

FIG. 6*c* shows that at the beginning of the suction, convection currents are established towards the other edge 28. Next, FIG. 6*c'* shows that the film is pulled toward the suction nozzle 32*a* and is stretched sideways with particles moving along the layer 50. Therefore, the particles continue to become organized by still further causing reduction in the voids, and by causing continuation of the ordering of the film. A flow rate of the order of 65 mL/min may also be applied.

Figure 6D:
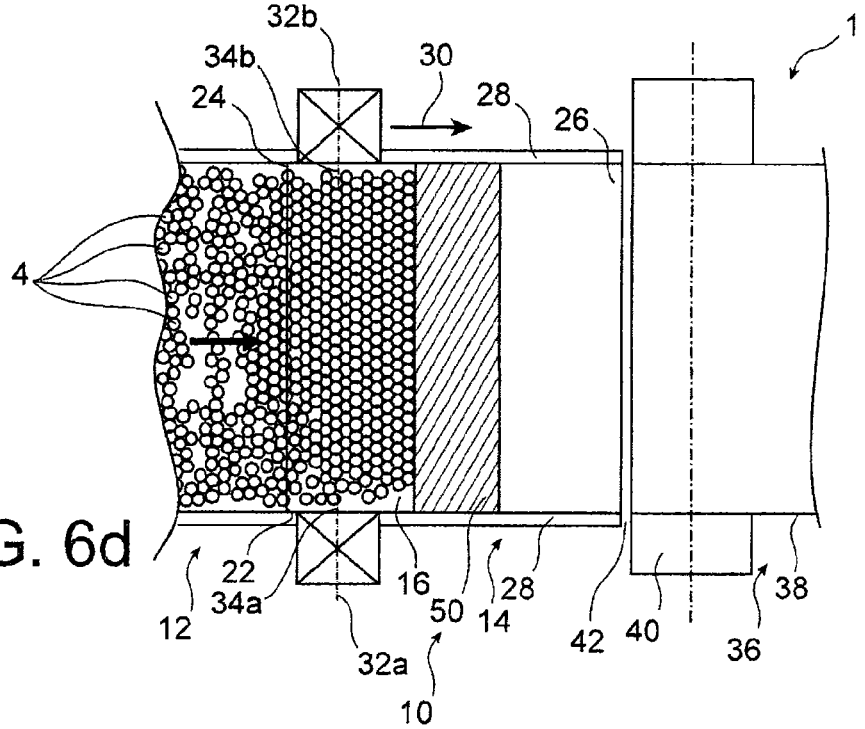

The nozzle 32*a* is then disabled, for a stoppage time during which the particles 4 may again reorder, as shown in FIG. 6*d*, in particular by the pressure exerted by the particles arriving into the transfer area.

The suction alternation described above may be repeated as many times as required, each suction time and each stoppage time lasting for about 15 to 30 seconds for example. Activation of the nozzle is normally stopped after completely filling the portion of the transfer area 14 located upstream from the layer 50.

As the particles 4 are gradually injected onto the ramp 12 and penetrate into the transfer area 14, the upstream front of particles tends to shift upstream, towards the inflexion line 24. Injection of particles is continued even after this upstream front has passed the line 24, so that it moves back up onto the tilted ramp 12.

Figure 7:
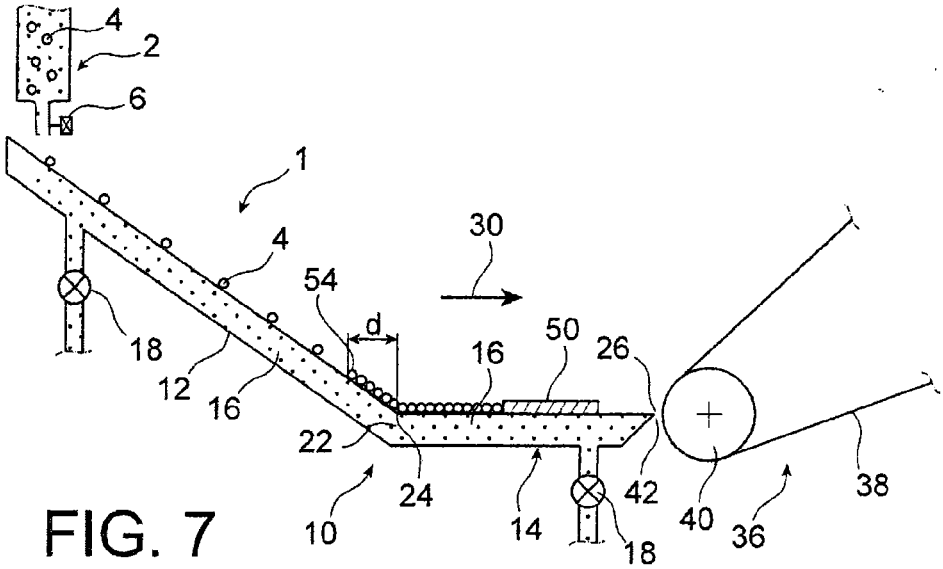
Figure 8:
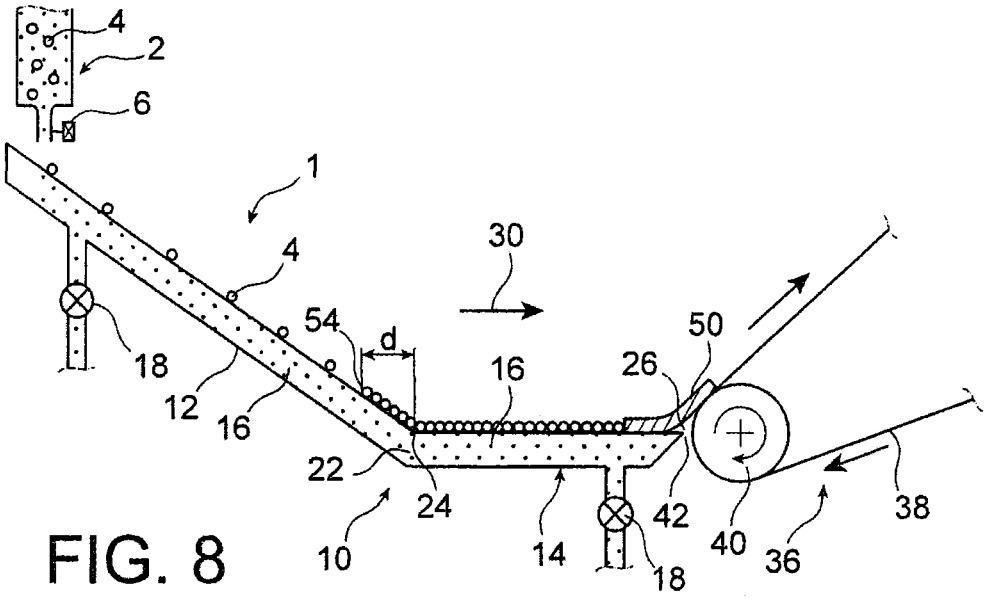

It is ensured that the upstream front of particles 54 moves back up onto the ramp 12 so that it is located at a given horizontal distance <<d>> from the inflexion line 24, as shown in FIG. 7. The distance <<d>> may be of the order of 30 mm.

At this instant, the particles 4 are perfectly ordered in the transfer area and on the ramp 12, on which they become ordered automatically, without any assistance, by their kinetic energy utilized at the moment of the impact on the front 54. The ordering is of the type of the one shown in FIG. 6*d* in proximity to the layer 50*a*, i.e. the obtained film in every point has a so-called <<compact hexagonal>> structure, in which each particle 4 is surrounded and in contact with six other particles 4 in contact with each other.

It is only from this instant that the layer 50 is moved downstream, towards the exit 26 and the substrate 38, while continuing to retain the particles with its upstream end. The displacement rate of the layer 50, at the surface of the carrier liquid 16, is adapted so that the position of the upstream front 54 of particles remains substantially unchanged. The means for providing this displacement as for them are standard, even if manual displacement may be contemplated, without departing from the scope of the invention. The displacement rate of the layer 50 may be of the order of 1.3 mm/s.

When the downstream end of the layer 50 arrives at the exit 26, the substrate 38 is set into motion, and then the layer 50 is deposited onto this same substrate 38 like the film of particles which follows it, by following the capillary bridge 42. This stage of the method was schematized in FIG. 8.

Figure 9:
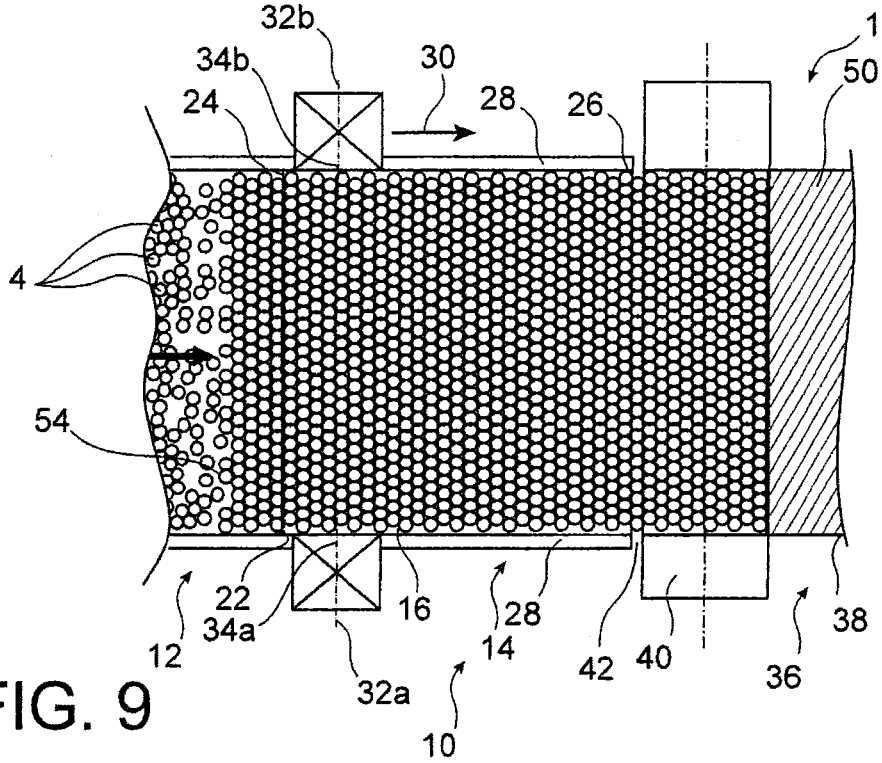

Next, it is the turn of the film of ordered particles to be deposited onto the substrate 38, in the continuity of the layer 50, as this was schematized in FIG. 9, in the way of how this is described in document CA 2 695 449.

Figure 10:
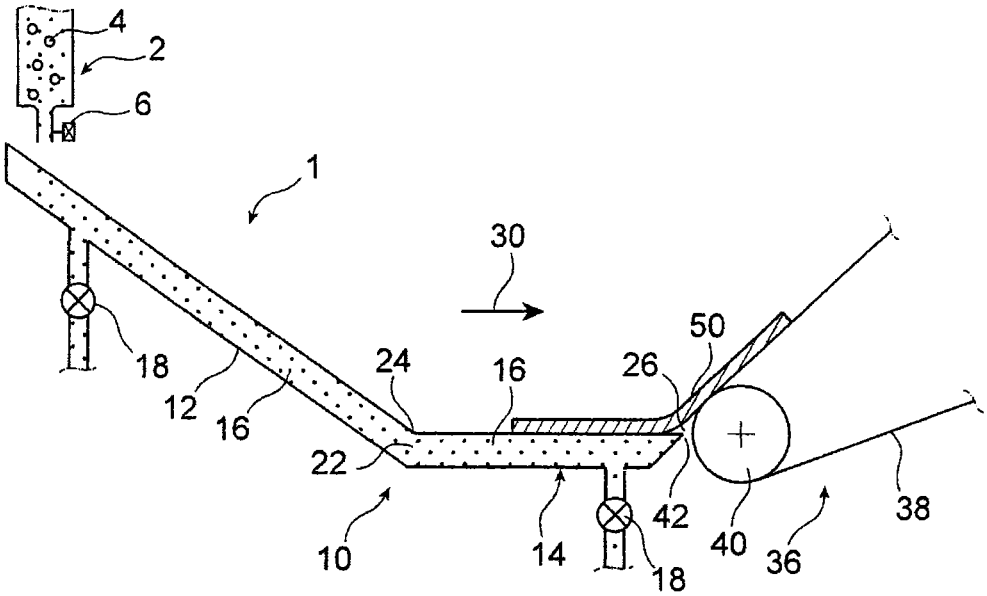
FIG. 10 illustrates an alternative for applying the method schematized in FIGS. 3 to 9.

In an alternative embodiment shown in FIG. 10, the layer 50 initially extends as far as on the substrate 38, so as to do without the presence of additional means allowing it to be set into motion as far as the substrate. Indeed, the layer 50 may be directly driven by the moving substrate, onto which it is initially deposited preferably manually.

Of course, various modifications may be brought to the invention which has just been described, by one skilled in the art, only as non-limiting examples.

The invention claimed is:

1. A facility for depositing a film of ordered particles onto a moving substrate, the facility comprising:

a transfer area comprising an entry of particles and an exit of particles spaced apart from each other by two side edges facing each other, retaining a carrier liquid on which the particles float;

the facility configured to allow deposition, onto the substrate, of the film of ordered particles escaping through the exit of particles; and further comprising a plurality of suction nozzles configured to attract the particles present in the transfer area towards its two side edges.

2. The facility according to claim 1, only including two suction nozzles, respectively capable of attracting the particles present in the transfer area towards the two side edges.

3. The facility according to claim 1, further comprising a tilted ramp for circulation of the particles, attached to the entry of the transfer area, and on which the carrier liquid can also circulate.

4. The facility according to claim 1, further comprising means for temporarily retaining the particles in the transfer area at a distance from the substrate, the retention means capable of being moved towards the substrate while retaining the particles.

5. The facility according to claim 4, wherein the means for temporarily retaining the particles assumes a form of a layer in a hydrophobic material, floating at a surface of the carrier liquid.

6. The facility according to claim 5, wherein the means for temporarily retaining the particles assumes a form of a layer with a thickness between a few microns and a few tens of microns.

7. The facility according to claim 5, wherein the means for temporarily retaining the particles assumes a form of a layer in polytetrafluoroethylene (PTFE).

8. The facility according to claim 5, wherein the means for temporarily retaining the particles assumes a form of a layer, a downstream end of which is also located at a distance from the substrate.

9. The facility according to claim 5, wherein the means for temporarily retaining the particle assumes a form of a layer, a downstream end of which is located on the substrate.

10. The facility according to claim 5, wherein the means for temporarily retaining the particle assumes a form of a layer capable of being deposited onto the substrate.

11. The facility according to claim 4, wherein the means for temporarily retaining the particles includes an upstream end located at a distance of less than 20 mm from an entry of the transfer area.

12. A method for depositing a film of ordered particles onto a moving substrate, by a facility according to claim 4, wherein, during at least one portion of an initial filling the transfer area with the particles, the suction nozzles are actuated to attract the particles present in the transfer area towards its two side edges.

13. The method according to claim 12, wherein the nozzles are alternately actuated so as to attract the particles present in the transfer area towards the two side edges, alternately.

14. The method according to claim 12, wherein, after setting into place the means for temporarily retaining the particles in the transfer area at a distance from the substrate and after initially filling with particles the portion of the transfer area located upstream from the means for temporarily retaining the particles, the means for temporarily retaining the particles are moved in the transfer area towards the substrate, while retaining the particles.

15. The method according to claim 14, wherein the means for temporarily retaining the particles assumes a form of a layer which is gradually deposited onto the moving substrate, while a downstream front of the film of ordered particles which it retains moves towards an exit of the transfer area.

* * * * *